United States Patent [19]

Tandberg

[11] Patent Number: 5,016,718

[45] Date of Patent: May 21, 1991

[54] COMBINATION DRILL BIT

[75] Inventor: Geir Tandberg, Biskop Sigurdsgt. 11,, N-7042 Trondheim, Norway

[73] Assignees: Geir Tandberg; Arild Rodland, both of Trondheim, Norway

[21] Appl. No.: 469,244

[22] Filed: Jan. 24, 1990

[30] Foreign Application Priority Data

Jan. 26, 1989 [NO] Norway ..... 890327

[51] Int. Cl.[5] ..... E21B 10/04; E21B 10/14

[52] U.S. Cl. ..... 175/333; 175/336; 175/404

[58] Field of Search ..... 175/332, 333, 335, 336, 175/393, 404, 339, 340, 408

[56] References Cited

U.S. PATENT DOCUMENTS

| | | | |
|---|---|---|---|
| 1,836,638 | 12/1931 | Wright et al. | 175/333 |
| 2,034,073 | 3/1936 | Wright | 175/333 |
| 2,975,849 | 3/1961 | Stuart | 175/333 |
| 3,055,443 | 9/1962 | Edwards | 175/404 |
| 3,075,592 | 1/1963 | Overly et al. | 175/333 |
| 3,100,544 | 8/1963 | Overly et al. | 175/333 |
| 4,640,375 | 2/1987 | Barr et al. | 175/410 |
| 4,694,916 | 9/1987 | Ford | 175/404 |

*Primary Examiner*—Bruce M. Kisliuk

*Attorney, Agent, or Firm*—Cushman, Darby & Cushman

[57] ABSTRACT

A drill bit for drilling a hole in the ground, with cutting elements annularly cutting a core which, when it has reached a certain height, is continuously crushed by teeth on rolling cones. By combining these two processes, cutting and crushing, in this manner an improved drilling advancement is achieved as compared to separate use of the same processes. The cutting elements show relatively small variations as to radial positioning, which renders it possible to find a common approximately optimal rotational speed of said elements. The core is weak and may be drilled out relatively easily by the aid of crushing, as compared to drilling pure holes. This is due to the fact that the core geometry causes a more efficient growth of fractures for each tooth penetration, and that the core, due to annular cutting, is free from radial tensions from the surrounding rock formations. In order to increase the life of the PDC cutting element, the mechanical strength of said element is improved due to the fact that the edge of the element is rounded with a small visible radius.

5 Claims, 3 Drawing Sheets

2
8
17
19
1
9
7
11
5
3
16
V
6
V
6
18
10
7
4

COMBINATION DRILL BIT

BACKGROUND OF THE INVENTION

The invention relates to a combination drill bit which is designed to drill holes by annular cutting and continuous core breaking.

The new combination drill bit is designed to carry out a process for drilling by annular cutting and continuous core breaking. Experiments were carried out with jet beams cutting a core by annular cutting, which core is broken by a rock bit, cf. Maurer, W. C. Heilhecker, J. K. and Love, W. W., "High Pressure Drilling"—Journal of Petroleum Technology, July 1973. These experiments resulted in an increase of the drilling rate by 2–3 times. The problem in utilizing a jet beam is that it requires a down-hole pump, which is able to produce the very high pressure necessary to enable the liquid beam to cut the formation.

Previously, PDC (polycrystalline diamond compact) cutting elements and rock bits with teeth were combined, but then mainly with the intention to limit drilling advancement in soft formations in order to avoid clogging of the cutting elements, cf. U.S. Pat. No. 4,006,788.

At present, mainly two kinds of drill bits are used, i.e. PDC drill bits and rock bits. PCD drill bits cut the formation with the aid of an edge comprised of a number of PCD cutting elements. Due to the fact that the cutting elements rotate at the same rotational speed about a common axis, cutting speed will vary from zero at the center, to a maximum outermost on the periphery of the drill bit. It is, thus, impossible to achieve an optimal cutting speed of all cutting elements at the same time.

The cuttings formed when PDC cutting elements are used, often are very small, resulting in the fact that very limited geological information can be extracted from them. PDC-bits were constructed which cut a small core for use in geological analysis, cf. U.S. Pat. No. 4,440,247. Drilling operators reported that the their effect as regards acquiring larger pieces is quite low.

The edge of a present PDC cutting element is 90° and sharp. Consequently, it is comparatively weak and tends to chip.

Rock bits break up the formation, by teeth which are mounted on the rock bits being urged towards the formation by so high a force that the formation will break under and around said teeth. Due to the relatively plane face of the hole bottom, crack propagation due to each tooth penetration is of relatively small effect as regards the volume to be drilled. If the volume to be broken is acquired in the shape of an unstabilized core, the efficiency of each tooth penetration will be considerably improved.

Conventionally, the principle of annular cutting with continuous core breaking is not used, at present, for drilling holes. There are a number of patents based on this principle. According to one patent, diamonds baked into a matrix are used. This system provides for more grinding than cutting, requiring high rpm to achieve a satisfactory drilling advancement. The central rolling cones, which are used to break the core, then have to be run at too high rpm, cf. U.S. Pat. No. 3,055,443. According to another patent, edges of tungsten carbide are used, resulting in a very limited life of the drill bit due to insufficient resistance to abrasion of the edges. The last mentioned drill bit does not generate a cavity about the core before it is broken, i.e. the internal wall of the core drill bit has a stabilizing effect on the core, cf. U.S. Pat. No. 3,075,592. A third patent discloses utilizing cutting edges requiring channels/grooves in front of/-behind the edges. The channels/grooves must be large enough to permit the pieces of broken core to pass to the outside of the drill bit. The core is broken by the aid of a toothed roller which has too much scraping effect due to its geometry. This will cause the teeth of the roller to be worn down far too rapidly. Nozzles are used to flush the toothed roller and to moisten the core so as to weaken it, cf. U.S. Pat. No. 2,034,073.

SUMMARY OF THE INVENTION

It is an object of the present invention to utilize cutting edges of polycrystalline diamond and/or a ceramic material for annular cutting of a core which is then continuously broken or crushed. It is essential in this connection to achieve a core that may be readily crushed. At the same time the proportions of the core must be correct in view of the total volume which has to be removed in the actual case to drill the hole. This means that an unstabilized core showing correct height and diameter relative to the drill hole diameter should be achieved. Shear stresses inherent in the core can then be activated in an advantageous manner during crushing. Also annular cutting to provide said core is carried out with the aid of a tool and to an extent rendering the total drilling more efficient than conventional drilling.

According to the invention, a combination drill bit as mentioned above is provided.

It be important that the rock bit is dimensioned to cover the entire undercut end cavity cross-section, i.e. that the rock bit will also be efficient in the annular area which will be present in the cross-section between the internal wall of the end cavity and the cylindrical wall of the formed unstabilized core. Broken-off matter which is present in this area will be crushed by the rock bit and made to pass through the wall openings. The polycrystalline or ceramic cutting elements which are placed to form an annulus provide for excellent annular cutting in an efficient manner to form the core.

The formed unstabilized core will break down under the influence of the crushing means and the core matter may in an advantageous manner pass out through relatively low wall openings.

It is desirable to achieve good stabilization of the drill bit in the hole, and at the same time good transport of matter upwards, past the drill bit. This is achieved by the special design of the outside of the drill bit, with wide stabilizing wall portions alternating with channels for transport upwards of drilled matter. The channels are dimensioned to permit relatively large pieces to pass. The wall openings and the channels should be associated to permit pieces passing through the openings to pass on, via channels.

Theoretically, a fracture in a material will appear at the point where shear stress is at a maximum, i.e. the fracture will start in a plane at 45° relative to maximum shear stress. In rock the internal friction of the material is essential to which angles of fracture the material will develop. The angle of fracture may be written as follows:

$$\text{Angle of fracture} = 45° - \tfrac{1}{2}\ \text{internal frictional angle.}$$

The internal frictional angle of rock will vary from almost zero to more than 60°. Resulting angles of fracture are from almost 45° to less than 15°. When fractures are initiated, they will always develop along the path of least resistance. During continuous core breaking the fracture will generally not cross the center line of the core. Calculations on this basis show that the unstable core height should advantageously be between twice and 0.5 times the core diameter. The direction of maximum main stress is then assumed to be parallel with the direction of drilling. Experiments have shown that the lower one may be as low as 0.2, which is attributed to the shape of the core top during continuous crushing, as well as to variation of the direction of main stress. In view of energy considerations, the core should be as large as possible, but to ensure sufficient strength of the core drill bit the diameter of the core must be reduced relative to the hole diameter. Considering variations of cutting speed across the core drill bit, the core diameter should not be less than 0.4 times the drill hole diameter. For suitable annular cutting with continuous core crushing, the core diameter should, thus, be at least 0.4 times the drill hole diameter. It will then be possible to select an rpm value which is approximately optimal for all cutting elements.

According to the invention, one or a plurality of high pressure nozzles is advantageously connected with jet channels directed into the end cavity.

In order to prolong the life of cutting elements the mechanical strength of the edge may advantageously be improved by rounding the edge with a small visible radius.

BRIEF DESCRIPTION OF THE DRAWINGS

The invention shall now be disclosed in more detail with reference to the drawings in which.

DETAILED DESCRIPTION

Figure 1:
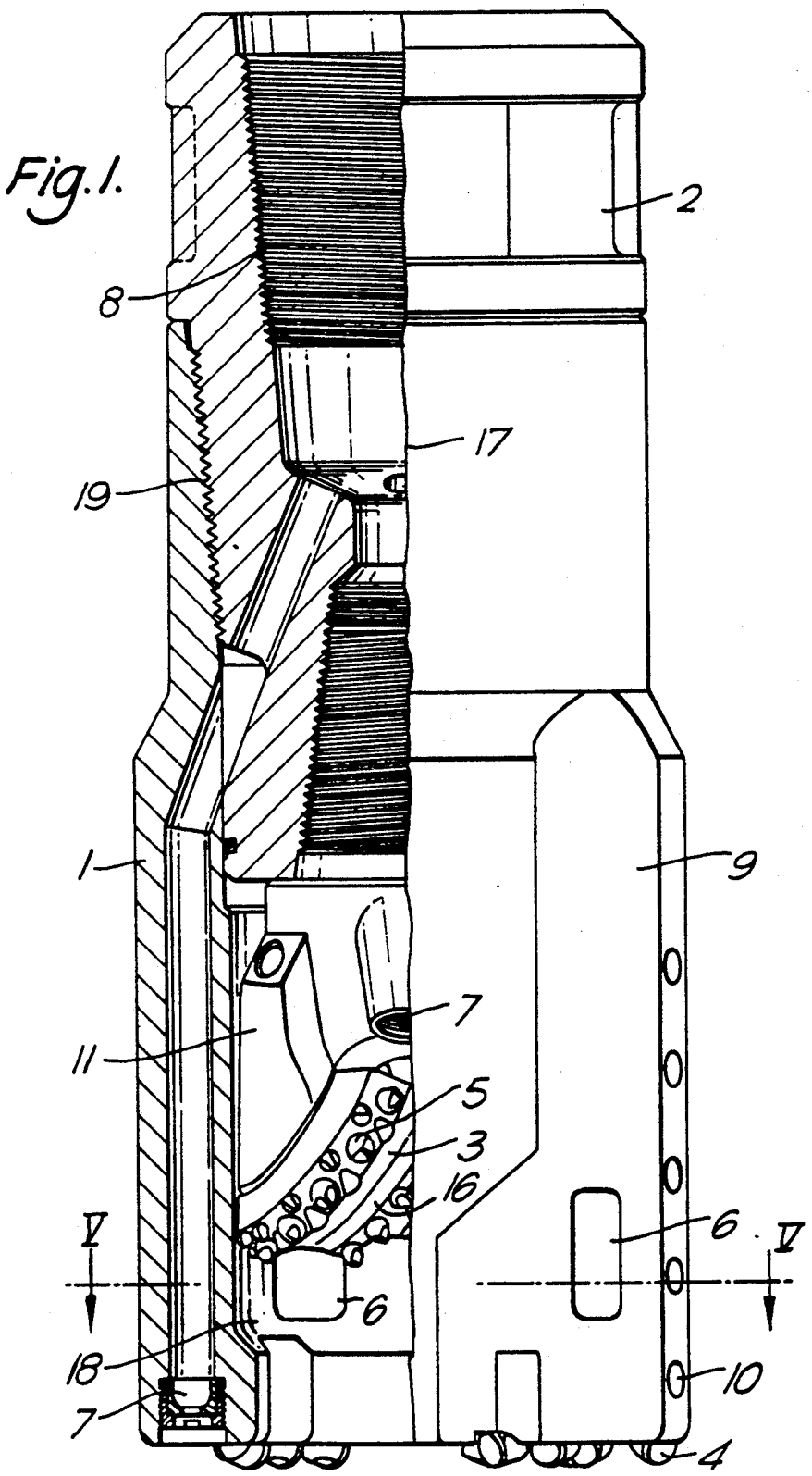
FIG. 1 shows a half longitudinal section of a drill bit according to the invention in an elevational view.
Figure 2:
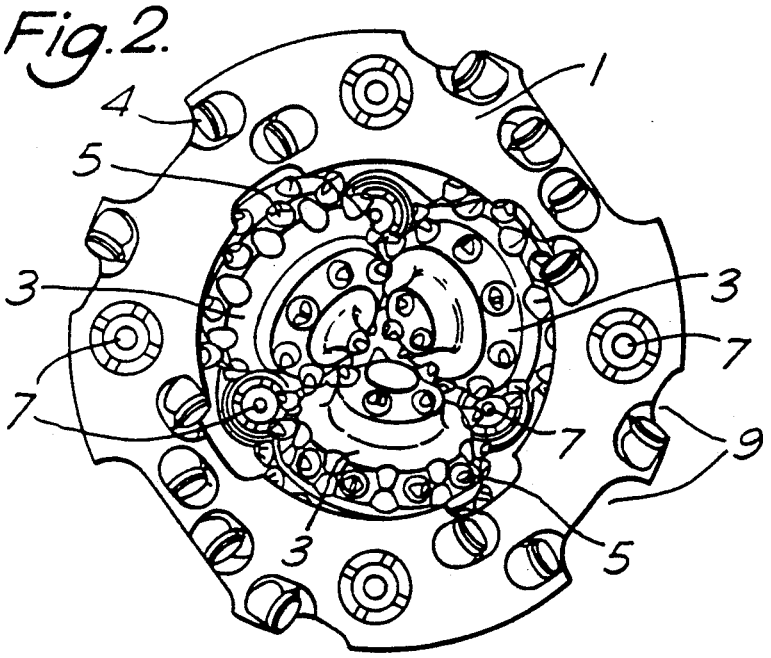
FIG. 2 is an end view of the drill bit.
Figure 3:
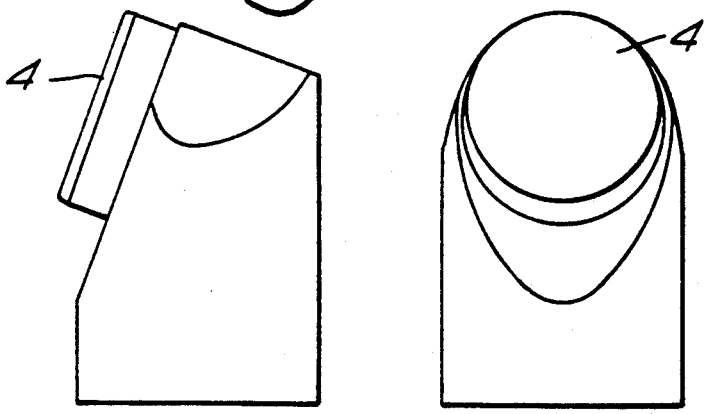
FIG. 3 shows a PDC cutting element, in which the edge has a visible radius.

In FIGS. 1 and 2, a common drill bit 11 with rolling cones 3 is shown. Additionally, PDC cutting elements 4 are shown, the axially and radially outer edge of each of which is provided with a visible radius, as shown in more detail in FIG. 3.

Figure 4:
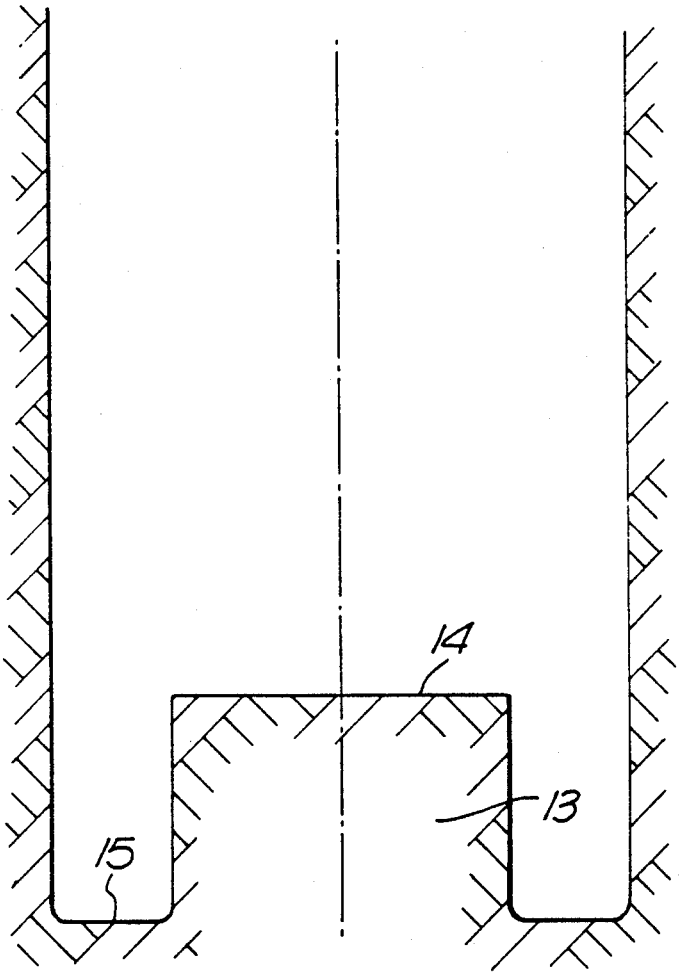
FIG. 4 shows in longitudinal section, the profile of the hole bottom formed by a drill bit according to FIGS. 1 and 2.

Cutting elements 4 are attached to a cylinder 1 and act against the annular drilling hole face 15, see FIG. 4. Rolling cones 3 with teeth 5 act, in use, against the top 14 of the cut-out core 13 to crush that top. Rolling cones 3 form part of a common rock bit 11. As shown in FIG. 1, rock bit 11 is secured in a drill bit fastening means 2 which is, in turn, connected with cylinder 1 with the aid of a threaded portion 19.

The drill bit rotates about central axis 17 and, at the same time, rolling cones 3 rotate about their own axis 16. Consequently, movement between rolling cones 3 and the base, which is core face 14 in this case, may be pure rolling movement. The pieces from the crushed portion of core 13 are transported with drilling fluid to the outside of the core drill bit through holes 6 in its wall. Above rolling cones 3 and at the end of the core drill bit, at the root of core 13 being drilled, nozzles 7 for drill mud open. The core drill bit and the rock bit are, as mentioned, connected by the aid of a drill bit fastening means 2, which is here also utilized for distribution of drilling fluid to nozzles 7.

Connection of the drill bit and remaining drilling equipment is achieved with threaded portion 8. Numeral 9 indicates channels for transport of drilled matter by the aid of the drilling fluid. Plugs 10 of a hard material will prevent reduction of diameter (in operation).

It will appear from FIG. 1 that end cavity 18 is undercut relative to the core diameter. A free annular space is, thus, achieved about the core to make core 13 unstabilized, which is essential in connection with subsequent crushing and removal of core material. By following the principles of the invention, a weak core is achieved, which core may be quite readily removed with the aid of crushing, as compared to drilling of conventional holes. As mentioned, this is due to the fact that the core geometry provides more efficient growth of fractures and that the core, due to annular cutting, will be free of radial tensions from surrounding rock. Overall, improved drilling advancement is achieved, as compared to the annular cutting and core breaking processes being used separately.

Figure 5:
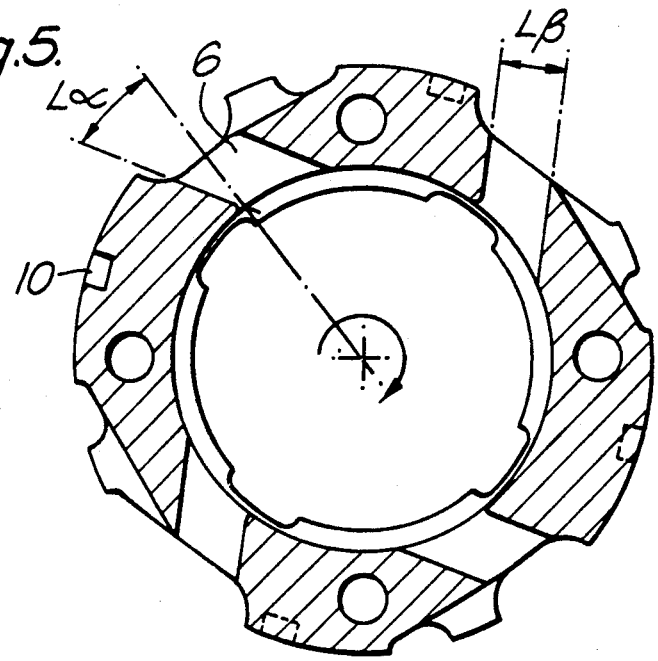
FIG. 5 is a transverse cross-sectional view taken along line V—V in FIG. 1.

FIG. 5 shows an advantageous design of wall openings 6. The tangent line to the rear wall of wall opening 6 in each point, apart from a rounding at the inlet, is rotated against the operational direction of rotation of the drill bit by an angle $\alpha$ relative to the drill bit sector line through the same point, as seen from the inlet of opening 6 towards its outlet, with $\alpha = \geqq 0°$ and $\leqq 90°$. By the rear wall of the opening is meant the side of the opening which is the last to pass a fixed sector line when the drill bit is rotated in an operative direction. By sector line is meant a straight line extending normally from the axis of rotation of the drill bit. By inlet to opening 6 is meant the side from which drilled out matter flows in through opening 6. In other words, the elements 6 are channels which, while opening generally radially through the drill bit body, have respective longitudinal axes which are slanted with respect to radians of the drill bit body, so as to dispose radially inner inlet ends of these channels angularly ahead of respective radially outer outlet ends thereof, by an angular amount in the range of $\geqq 0°$ to $\leqq 90°$.

As shown in FIG. 5, the polycrystalline cutting elements 10 are mounted in sockets extending perpendicular to the longitudinal axis of the combination drill bit, and their radially outer cutting surfaces are disposed so as to be tangent to the radially outer surface of the drill bit.

Having described my invention, I claim:

1. A combination drill bit for continuously drilling an annular, downwardly deepening hole coaxially surrounding an upwardly projecting cylindrical core having an upper end, and progressively crushing axially successive increments of said core from the upper end of said core, said drill bit comprising:

a generally cylindrical drill bit body having an upper end provided with means for fastening the drill bit body to means for rotating the drill bit; said drill bit body having a radially outer sidewall surface, and, coaxially therewith, means defining a downwardly opening internal cavity, thereby defining an annular cylindrical portion of said drill bit body, having an annular, axially downwardly facing lower end; said cavity increasing in diameter at a level which is above said lower end, whereby said internal cavity is undercut and has an axially short band of reduced internal diameter adjacent said lower end;

a plurality of downwardly acting cutting elements mounted on said lower end of said drill bit body and distributed across the radial extent of said lower end, so that as said drill bit body is rotated in a rock formation said cutting elements cut a downwardly deepening annular hole into the rock formation, leaving a coaxial, upwardly projecting core of rock having an upper end, said core progressively entering said cavity from below as said annular hole is deepened; said cutting elements being made of at least one of polycrystalline diamond compact and ceramic material;

means defining internal drilling fluid delivery channels extending downwards in said drill bit body and opening into said cavity and at sites arranged for supplying drilling fluid to said cutting elements mounted on said lower end of said drill bit body;

means defining channels opening generally radially through said drill bit body between said cavity and said radially outer sidewall surface of said drill bit body;

means defining a plurality of angularly spaced external longitudinal channels on said radially outer sidewall surface of said drill bit body for circulating drilling fluid and cuttings upwards in said hole in said rock formation;

a core crushing tool mounted to said drill bit body and disposed in said cavity above said band of reduced internal diameter; said core crushing tool including downwardly acting rotary crushing means having an effective diameter which is greater than that of said band of reduced internal diameter; said crushing means being mounted for rotation relative to downwardly acting cutting elements mounted on said lower end of said drill bit body;

said channels having inlet ends opening into said cavity at respective sites located axially between said core crushing tool and said band of reduced internal diameter of said drill bit body;

the distance axially of said drill bit body between said core crushing tool and said downwardly acting cutting elements on said lower end of said drill bit body being such as to provide, in use, that said core has an axial length which is between 0.5 and 2 times the outer diameter of said core; and the inner diameter of said band of reduced internal diameter and the outer diameter of said radially outer sidewall surface of said drill bit body being such as to provide, in use, that said core has an outer diameter which is at least 0.4 times the outer diameter of said hole in said rock formation.

2. The combination drill bit of claim 1, wherein:

said downwardly acting cutting element mounted on said lower end of said drill bit body are generally cylindrical elements having respective longitudinal axes which are oblique to the longitudinal axis of said drill bit; said generally cylindrical elements having axially outer, radially outer corners which are visibly beveled.

3. The combination drill bit of claim 1, wherein:

said radially outer sidewall surface of said drill bit body, between said external longitudinal channels provides external longitudinally extending stabilizers;

a plurality of polycrystalline diamond cutting elements socketed into said drill bit body on said stabilizers and having radially outwardly acting cutting surfaces which are substantially tangential to said radially outer sidewall surface of said drill bit body on said stabilizers.

4. The combination drill bit of claim 1, wherein:

said channels opening generally radially through said drill bit body have respective longitudinal axes which dispose radially inner inlet ends of respective ones of said channels angularly ahead of radially outer outlet ends thereof by an angular amount in the range of $\geqq 0°$ to $\leqq 90°$.

5. The combination drill bit of claim 1, wherein:

said core crushing tool is constituted by a drill bit having a plurality of rolling cutter-studded cones disposed for rotation about respective longitudinal axes which are oblique to the longitudinal axis of said drill bit body.

* * * * *